US008181371B2

(12) United States Patent
Londino

(10) Patent No.: US 8,181,371 B2
(45) **Date of Patent: *May 22, 2012**

(54) LABEL SLEEVE FOR MEDICATION DOSAGE REMINDER AND CONFIRMATION SYSTEMS

(76) Inventor: Patricia Londino, Watertown, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/081,639

(22) Filed: Apr. 7, 2011

(65) Prior Publication Data

US 2011/0185606 A1 Aug. 4, 2011

Related U.S. Application Data

(63) Continuation of application No. 11/770,877, filed on Jun. 29, 2007, now Pat. No. 7,921,583, which is a continuation-in-part of application No. 11/163,648, filed on Oct. 26, 2005, now Pat. No. 7,387,208.

(51) Int. Cl.
*G09F 3/20* (2006.01)

(52) U.S. Cl. ..... 40/310; 116/308; 206/534; 220/739; 229/403; 40/312; 40/107; 40/661; 283/81

(58) Field of Classification Search ..... 40/306, 40/310, 633, 5, 635, 637, 641, 649, 660, 40/661, 675; 73/428; 220/738, 737
See application file for complete search history.

(56) References Cited

U.S. PATENT DOCUMENTS

| | | | |
|---|---|---|---|
| 2,794,545 | A | 6/1957 | Olson |
| 2,831,278 | A | 4/1958 | Myers |
| 2,833,064 | A | 5/1958 | Parker |
| 2,888,159 | A | 5/1959 | Fields |
| 3,579,883 | A | 5/1971 | Hayes |
| 3,675,620 | A | 7/1972 | Baustin |
| 4,534,468 | A | 8/1985 | Nuckols et al. |
| 4,621,442 | A | 11/1986 | Mack |
| 4,661,188 | A | 4/1987 | Fumei |
| 4,752,087 | A | 6/1988 | Weisbach |
| 4,830,407 | A | 5/1989 | Sadler, Jr. et al. |
| 5,313,439 | A | 5/1994 | Albeck |
| 5,431,450 | A | 7/1995 | Coleman |
| 5,454,484 | A | 10/1995 | Chelossi |
| 5,605,230 | A | 2/1997 | Marino, Jr. et al. |

(Continued)

FOREIGN PATENT DOCUMENTS

| | | | |
|---|---|---|---|
| WO | 2007/084248 | A2 | 7/2007 |

(Continued)

*Primary Examiner* — Joanne Silbermann
*Assistant Examiner* — Shin Kim
(74) *Attorney, Agent, or Firm* — Jay R. Yablon

(57) ABSTRACT

A medication dosage reminder sleeve apparatus for use in connection with a medicine container, comprising: a sleeve material comprising a transparent surface thereof, comprising a closed surface with a circumference substantially equal to a circumference of the medicine container with which the apparatus is to be used, wherein the sleeve material will conform to a shape of, and fit snugly upon the medicine container, when placed over at least part of the medicine container; and affixed to the sleeve material, at least one dosage reminder system; wherein: the sleeve material omits any adhesive on a surface thereof which contacts the medicine container when placed thereover; the sleeve material in combination with the dosage reminder system can, at will, be attached to, removed from, and slidably adjusted upon the medicine container; and the transparency of the sleeve material enables information printed on the medicine container to be seen through the transparent sleeve material while the transparent sleeve material is placed over at least part of the medicine container.

16 Claims, 2 Drawing Sheets

U.S. PATENT DOCUMENTS

| | | | |
|---|---|---|---|
| 5,639,529 | A | 6/1997 | Gozdecki et al. |
| 5,660,138 | A | 8/1997 | Hirsch |
| 5,881,597 | A | 3/1999 | Brooks |
| 5,915,854 | A | 6/1999 | Burke et al. |
| 5,979,698 | A | 11/1999 | Deal |
| 6,047,488 | A | 4/2000 | Tuszkiewicz |
| 6,250,545 | B1 | 6/2001 | Mazzarolo et al. |
| 6,550,171 | B1 | 4/2003 | De Werra et al. |
| 6,581,972 | B2 | 6/2003 | Nojima et al. |
| 6,685,227 | B2 | 2/2004 | Merry et al. |
| 6,770,345 | B2 | 8/2004 | Sellars |
| 6,951,353 | B2 | 10/2005 | Kozlowski et al. |
| 7,032,535 | B2 | 4/2006 | Halstead et al. |
| 7,263,790 | B2 | 9/2007 | Richards |
| 7,387,208 | B2 | 6/2008 | Londino |
| 7,458,178 | B2 | 12/2008 | Paschall |
| 7,597,246 | B2 | 10/2009 | Stepanek, Jr. |
| 7,874,429 | B2 | 1/2011 | Londino |
| 7,921,583 | B2 | 4/2011 | Londino |
| 2001/0030140 | A1 | 10/2001 | Mundt |
| 2006/0197336 | A1 | 9/2006 | Londino |
| 2006/0278156 | A1 | 12/2006 | Miller |
| 2008/0010874 | A1 | 1/2008 | Londino |
| 2008/0236475 | A1 | 10/2008 | Londino |
| 2009/0202635 | A1 | 8/2009 | Scott |

FOREIGN PATENT DOCUMENTS

| | | | |
|---|---|---|---|
| WO | 2007/084248 | A3 | 7/2007 |

LABEL SLEEVE FOR MEDICATION DOSAGE REMINDER AND CONFIRMATION SYSTEMS

CROSS-REFERENCE TO RELATED APPLICATIONS

This application is a continuation of application U.S. Ser. No. 11/770,877 filed Jun. 29, 2007, now U.S. Pat. No. 7,921,583 issued Apr. 12, 2011, which in turn is a continuation-in-part of application U.S. Ser. No. 11/163,648 filed Oct. 26, 2005, now U.S. Pat. No. 7,387,208 issued Jun. 17, 2008. All of the foregoing are hereby incorporated by reference.

FIELD OF THE INVENTION

This invention relates to the field of medication dosage tracking, and in particular, to a system which enables easy placement and removal of label-based dosage reminder and confirmation systems.

BACKGROUND OF THE INVENTION

Most practitioner-prescribed medication, as well as over-the-counter medication, requires regimented usage for optimal results. In our fast-paced society, it is difficult for most people to maintain a medication-related schedule and to remember what has been taken and what still needs to be taken.

A survey of approximately one hundred people who take or have taken medication (the survey included pharmacists) was conducted by applicant to substantiate the belief that most people forget, or have forgotten to take their medication. The results of the survey was that ninety-nine percent of those people surveyed forget to take their medication, and that the majority of people forget to take their medications, more often than not. Not only do most people forget to take their medication, but just as important, most people, while in the process of remembering to take their medication, often forget if they have taken their last scheduled dose or not.

There do exist various label systems for reminding a medication user to take their medication and to help them remember (i.e., confirm) if they have already taken a scheduled dose. Typically, these label systems are adhered directly to the medicine container, see, for example, U.S. Pat. Nos. 4,752,087; 5,881,597; and 5,979,698. Once placed, these are not readily removed. Sometimes, the user may inadvertently mount the label system on top of dosage instructions printed in the container, which then obscures important information from the user.

It would be desirable to have a means of adhering a label system to a label-based medication dosage reminder and confirmation system which facilitates easy attachment of the label system to the medicine container, and also, which permits easy readjustment and removal even after the labels have initially been attached to the medicine container or like container.

It is would also be desirable to have a system which permits any pertinent medication information printed on the medication container to be viewed by the user, rather than obscured by the label system as is often the case.

SUMMARY OF THE INVENTION

Disclosed herein is a medication dosage reminder sleeve apparatus for use in connection with a medicine container, comprising: a sleeve material comprising a transparent surface thereof, comprising a closed surface with a circumference substantially equal to a circumference of the medicine container with which the apparatus is to be used, wherein the sleeve material will conform to a shape of, and fit snugly upon the medicine container, when placed over at least part of the medicine container; and affixed to the sleeve material, at least one dosage reminder system; wherein: the sleeve material omits any adhesive on a surface thereof which contacts the medicine container when placed thereover; the sleeve material in combination with the dosage reminder system can, at will, be attached to, removed from, and slidably adjusted upon the medicine container; and the transparency of the sleeve material enables information printed on the medicine container to be seen through the transparent sleeve material while the transparent sleeve material is placed over at least part of the medicine container.

BRIEF DESCRIPTION OF THE DRAWINGS

The features of the invention believed to be novel are set forth in the appended claims. The invention, however, together with further objects and advantages thereof, may best be understood by reference to the following description taken in conjunction with the accompanying drawing(s) summarized below.

DETAILED DESCRIPTION

Figure 1:
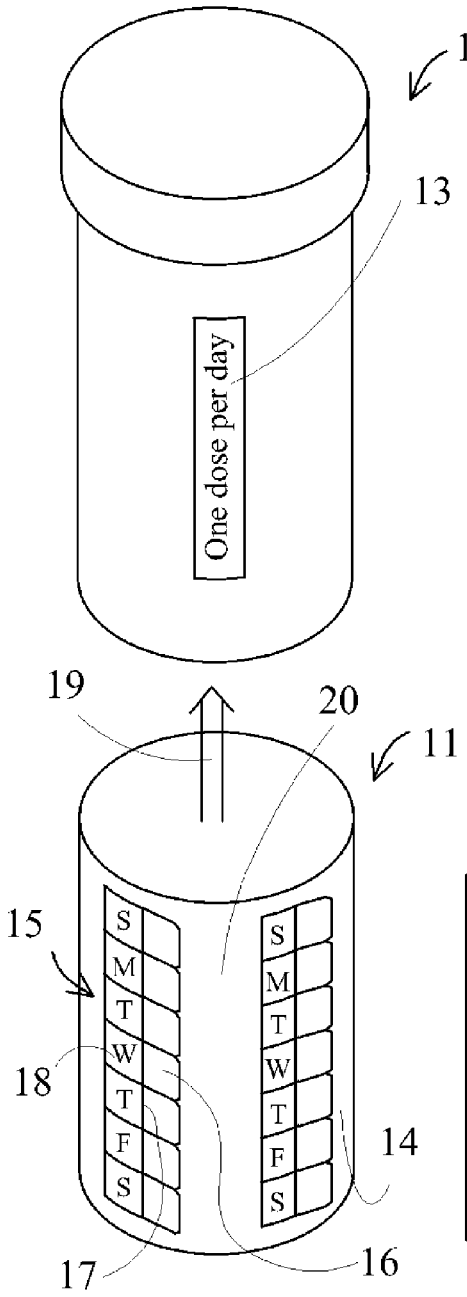
FIG. 1 illustrates a standard medication container such as a pill bottle commonly distributed by a pharmacy, juxtaposed above a dosage reminder and confirmation sleeve in an embodiment of the invention.

FIG. 1 illustrates a medication dosage reminder and confirmation sleeve 11 juxtaposed below a standard medicine container 12. While we use a standard container for purpose of illustration, the invention disclosed is meant to apply to containers with a variety of widths and heights. Medicine container 12 also contains affixed thereto medication information 13, illustrated here as a reminder that the medication is to be taken at one dose per day. This medication information 13 may comprise any and all other information which a pharmacy or physician, etc., may place on medicine container 12 including but not limited to the name of the medication, indications or reactions, information about refills, etc.

Figure 3:
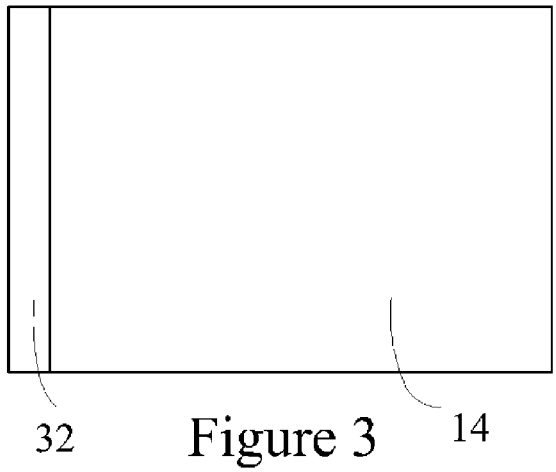
FIG. 3 illustrates the transparent material used for dosage reminder and confirmation sleeve, in an unrolled form before it is adjoined to form dosage reminder sleeve.

Dosage reminder and confirmation sleeve 11 is fabricated from a substantially transparent sleeve material 14 such but not limited to a clear, transparent plastic. Dosage reminder and confirmation sleeve 11 is fabricated into closed surface as illustrated, and to have substantially the same circumference as the medicine container 12 with which it is intended to be used. This allows a snug fit when dosage reminder and confirmation sleeve 11 is slid over at least part of medicine container 12. For example, transparent sleeve material 14 may be manufactured as a flat plastic sheet shown in FIG. 3, and two ends then adjoined together in a overlap section 32 to achieve closure in any manner of securing together two end sections, that is known or may become known in the art.

Figure 2:
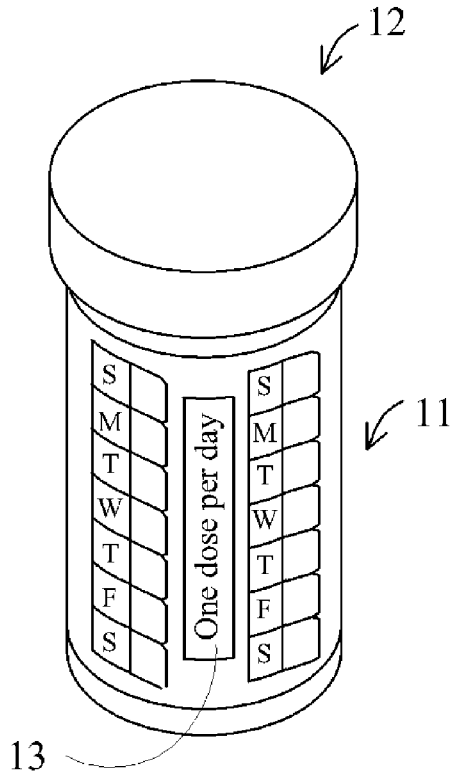
FIG. 2 illustrated this same medication container after the dosage reminder and confirmation sleeve of this invention embodiment has been installed over the container.

As illustrated in FIGS. 1 and 2, the closed surface of dosage reminder and confirmation sleeve 11 is a cylinder, as is medicine container 12. This is for example, not limitation. For a medicine container of a different shape (for example, a substantially flat medicine container 12, perhaps with so-called "blister packs," or for a square or triangular or ovular container), dosage reminder and confirmation sleeve 11 continues to comprise a closed surface conformable to the same shape as medicine container 12. In other words, it is important that reminder and confirmation sleeve 11 comprise substantially the same circumference as the medicine container 12 to ensure a snug, conforming fit over the medicine container 12, no matter what shape medicine container 12 comprises. The use of a cylindrical shape in the drawings is an example, and not in any way meant to preclude other shapes, and therefore, sleeves which will conform to these other shapes.

Affixed to dosage reminder and confirmation sleeve 11 are one or more tearable dosage reminder and confirmation sheets 15 comprising a plurality of dosage tabs 16, which are designed such that, when the user takes a dose of medication, the user removes a tab 16, which tears off along tear line 17, but leaves behind a residue portion 18 which is an indicator that the dose associated with the removed tab has been consumed. Thus, for example, were the use to tear off the specific tab at 16, leaving behind the "W" shown at 18, this would constitute an indicator to the user that the Wednesday dosage had been consumed. (Days of the month, or any other suitable indicator may be used, and various systems of labeling the tabs may be employed, all within the scope of this disclosure and its associated claims.) The dosage reminder and confirmation sheets 15 may be in the form of a single layer of tabs as illustrated, or, for example, the multi-layer tabs illustrated in copending application U.S. Ser. No. 11/163,648, see also FIG. 5 herein. It should be clear that by affixing five such dosage reminder and confirmation sheets 15 about the circumference of dosage reminder and confirmation sleeve 11, the user can track an entire month worth of medication use, irrespective of the start and end days of the medication usage.

To use dosage reminder and confirmation sleeve 11, the user slides reminder and confirmation sleeve 11 over medicine container 12 at will, as schematically illustrated by 19. Once this is done, the resulting configuration is that of FIG. 2. The dosage reminder and confirmation sheets 15 are now carried with medicine container 12, so that the user can tear off tabs as a dose is consumed in the manner just described. Because reminder and confirmation sleeve 11 with reminder and confirmation sheets 15 is attachable to, and removable from, and adjustable upon medicine container 12, at will, great flexibility is afforded to the user of this system. The transparency of sleeve material 14 allows the use to see through the intermediate sections 20 over which there is no dosage reminder and confirmation sheet 15, in order to read what is on the bottle such as medication information 13. If there is information printed in several places on medicine container 12, then dosage reminder and confirmation sleeve 11 may either be rotated circumferentially around medicine container 12 as the user reads the information, or, the user may simply remove reminder and confirmation sleeve 11 for a brief time in order to read what is on medicine container 12, and can then return reminder and confirmation sleeve 11 back over medicine container 12 into the configuration of FIG. 2.

Figure 4:
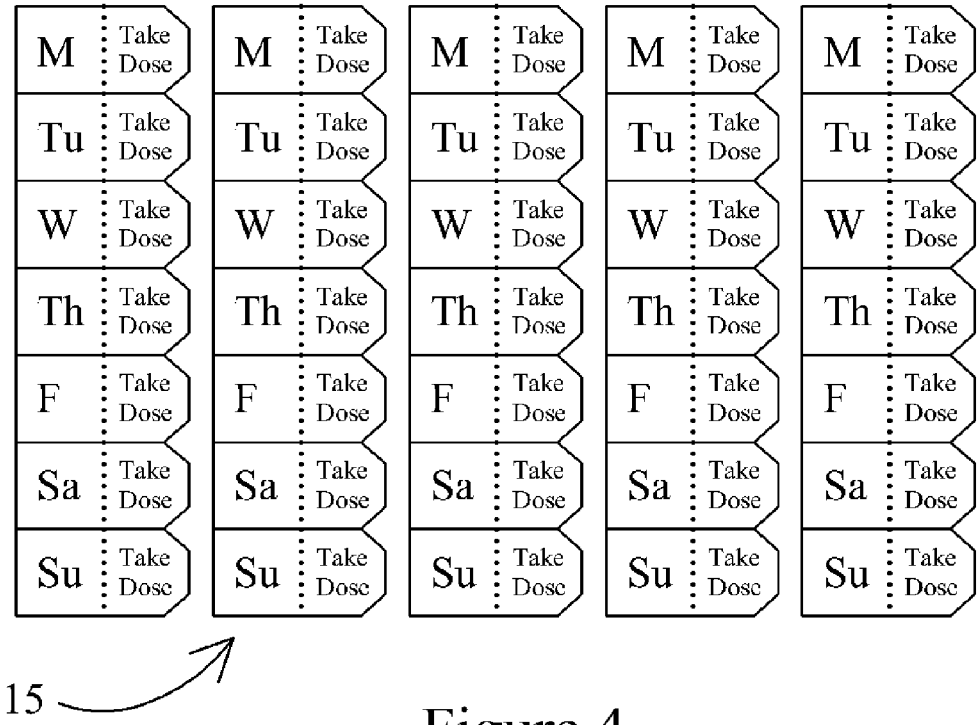
FIGS. 4 and 5 illustrate examples of tab systems which can be mounted via dosage reminder and confirmation sleeve in accordance with the invention.
Figure 5:
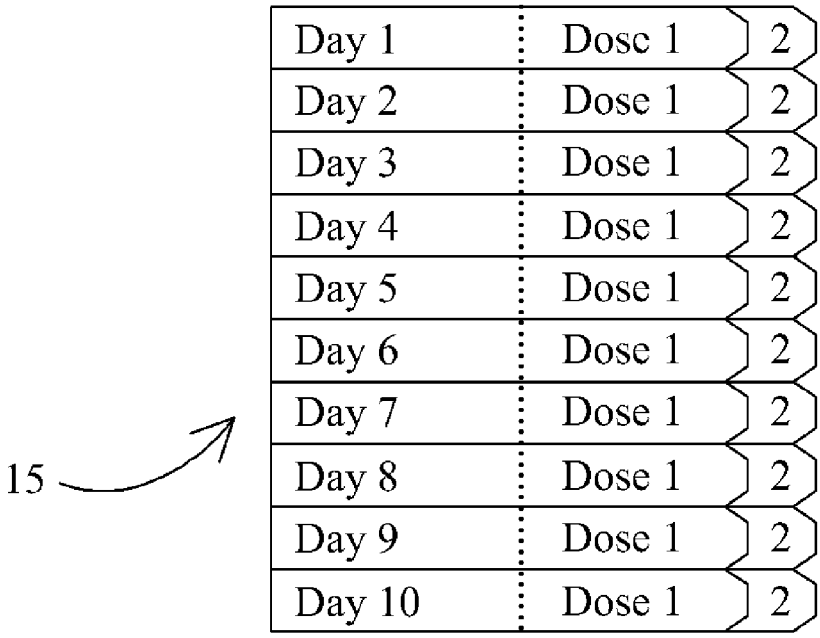

While FIGS. 1 and 2 illustrate a particular dosage reminder and confirmation sheet 15 also shown in FIG. 4, which contains 35 days of tracking and can therefore be used to cover a full month of dosage, this is sample an example of the types of tab systems which can be mounted via dosage reminder and confirmation sleeve 11. FIG. 5, for example, illustrates two-dose-per day-for-ten-day dosage reminder and confirmation sheets 15. Three such sheets mounted upon dosage reminder and confirmation sleeve 11 will serve to cover 30 days of use at two doses per day. A three-layer dosage reminder and confirmation sheet 15 may be use for three-per-day doses, and so on. These examples are intended to be illustrative, not limiting.

As noted earlier, by attaching one or more dosage reminder and confirmation sheets 15 to the medicine container 12, not directly, but rather, via pre-affixation to dosage reminder and confirmation sleeve 11 and then, in turn, by attachment of dosage reminder and confirmation sleeve 11 to medicine container 12, the user is afforded great flexibility, and can easily reposition or remove the dosage reminder and confirmation sheets 15 in such a way as to view any and all medication information 13 printed on medicine container 12. The user can then restore dosage reminder and confirmation sleeve 11 and its pre-affixed dosage reminder and confirmation sheets 15 to the medicine container 12.

The use of dosage reminder and confirmation sheets 15 which are tearable is for illustration, and does not preclude other types of reminder and confirmation systems that are similarly attached via an intermediating dosage reminder and confirmation sleeve 11.

The knowledge possessed by someone of ordinary skill in the art at the time of this disclosure is understood to be part and parcel of this disclosure and is implicitly incorporated by reference herein, even if in the interest of economy express statements about the specific knowledge understood to be possessed by someone of ordinary skill are omitted from this disclosure. While reference may be made in this disclosure to the invention comprising a combination of a plurality of elements, it is also understood that this invention is regarded to comprise combinations which omit or exclude one or more of such elements, even if this omission or exclusion of an element or elements is not expressly stated herein, unless it is expressly stated herein that an element is essential to applicant's combination and cannot be omitted. It is further understood that the related prior art may include elements from which this invention may be distinguished by negative claim limitations, even without any express statement of such negative limitations herein. It is to be understood, between the positive statements of applicant's invention expressly stated herein, and the prior art and knowledge of the prior art by those of ordinary skill which is incorporated herein even if not expressly reproduced here for reasons of economy, that any and all such negative claim limitations supported by the prior art are also considered to be within the scope of this disclosure and its associated claims, even absent any express statement herein about any particular negative claim limitations.

Finally, while only certain preferred features of the invention have been illustrated and described, many modifications, changes and substitutions will occur to those skilled in the art. It is, therefore, to be understood that the appended claims are intended to cover all such modifications and changes as fall within the true spirit of the invention.

I claim:

1. A medication dosage reminder sleeve apparatus for use in connection with a medicine container, comprising:

a sleeve material comprising a transparent surface thereof, comprising a closed surface with a circumference substantially equal to a circumference of the medicine container with which said apparatus is to be used, wherein said sleeve material will conform to a shape of, and fit snugly upon the medicine container, when placed over at least part of the medicine container; and affixed to said sleeve material, at least one dosage reminder system; wherein:

said sleeve material omits any adhesive on a surface thereof which contacts the medicine container when placed thereover;

said sleeve material in combination with said dosage reminder system can, at will, be attached to, removed from, and slidably adjusted upon the medicine container; and said transparency of said sleeve material enables information printed on the medicine container to be seen through said transparent sleeve material while said transparent sleeve material is placed over at least part of the medicine container.

2. The apparatus of claim 1, said dosage reminder system comprising one tearable dosage reminder and confirmation sheet comprising a single layer of said dosage tabs.

3. The apparatus of claim 1, said dosage reminder system comprising one tearable dosage reminder and confirmation sheet comprising at least two layers of said dosage tabs.

4. The apparatus of claim 1, said dosage reminder system comprising more than one tearable dosage reminder and confirmation sheet comprising a single layer of said dosage tabs.

5. The apparatus of claim 1, said dosage reminder system comprising more than one tearable dosage reminder and confirmation sheet comprising at least two layers of said dosage tabs.

6. The apparatus of claim 1, wherein said sleeve material is sized and shaped to conform to, and fit snugly upon, a substantially-cylindrical medicine container.

7. The apparatus of claim 1, wherein said sleeve material is sized and shaped to conform to, and fit snugly upon, a substantially-flat medicine container.

8. The apparatus of claim 1, wherein said sleeve material is sized and shaped to conform to, and fit snugly upon, a substantially-square medicine container.

9. A reminder method for a user of medicine, comprising:

placing a sleeve material comprising a transparent surface thereof with at least one dosage reminder system affixed thereto, over at least part of a medicine container;

said sleeve material comprising a closed surface with a circumference substantially equal to a circumference of the medicine container, said sleeve material thereby conforming to a shape of, and fitting snugly upon the medicine container, when placed over the medicine container;

said sleeve material omitting any adhesive on a surface thereof contacting the medicine container when placed thereover;

said sleeve material in combination with said dosage reminder system attaching to, removing from, and slidably adjusting upon the medicine container, at will; and said transparency of said sleeve material enabling information printed on the medicine container to be seen through said transparent sleeve material while said transparent sleeve material is placed over at least part of the medicine container.

10. The method of claim 9, said dosage reminder system comprising at least one tearable dosage reminder and confirmation sheet comprising one tearable dosage reminder and confirmation sheet comprising a single layer of said dosage tabs.

11. The method of claim 9, said dosage reminder system comprising at least one tearable dosage reminder and confirmation sheet comprising one tearable dosage reminder and confirmation sheet comprising at least two layers of said dosage tabs.

12. The method of claim 9, said dosage reminder system comprising at least one tearable dosage reminder and confirmation sheet comprising more than one tearable dosage reminder and confirmation sheet comprising a single layer of said dosage tabs.

13. The method of claim 9, said dosage reminder system comprising at least one tearable dosage reminder and confirmation sheet comprising more than one tearable dosage reminder and confirmation sheet comprising at least two layers of said dosage tabs.

14. The method of claim 9, further comprising attaching said sleeve material to a substantially-cylindrical medicine container.

15. The method of claim 9, further comprising attaching said sleeve material to a substantially-flat medicine container.

16. The method of claim 9, further comprising attaching said sleeve material to a substantially-square medicine container.

* * * * *